US011285347B2

(12) United States Patent
Ryczek

(10) Patent No.: US 11,285,347 B2
(45) Date of Patent: Mar. 29, 2022

(54) CARTRIDGE MONITORING SYSTEM

(71) Applicant: Tyco Fire Products LP, Lansdale, PA (US)

(72) Inventor: Chad L. Ryczek, Oconto Falls, WI (US)

(73) Assignee: Tyco Fire Products LP, Lansdale, PA (US)

( * ) Notice: Subject to any disclaimer, the term of this patent is extended or adjusted under 35 U.S.C. 154(b) by 67 days.

(21) Appl. No.: 16/435,273

(22) Filed: Jun. 7, 2019

(65) Prior Publication Data

US 2019/0374803 A1 Dec. 12, 2019

Related U.S. Application Data

(60) Provisional application No. 62/682,506, filed on Jun. 8, 2018.

(51) Int. Cl.
*A62C 37/36* (2006.01)
*A62C 35/02* (2006.01)
(Continued)

(52) U.S. Cl.
CPC ..... *A62C 37/36* (2013.01); *A62C 35/023* (2013.01); *A62C 35/13* (2013.01); *A62C 37/50* (2013.01)

(58) Field of Classification Search
CPC ..... A62C 37/36; A62C 35/023; A62C 35/13; A62C 37/50; H01R 13/621; H01R 13/622; H01R 33/22
(Continued)

(56) References Cited

U.S. PATENT DOCUMENTS 4,003,048 A * 1/1977 Weise ..... G08B 13/1472 340/568.4
4,653,829 A * 3/1987 LaMont ..... H01R 33/22 439/206
(Continued)

FOREIGN PATENT DOCUMENTS

CN 102113957 A 7/2011
CN 103127579 A 6/2013
(Continued)

OTHER PUBLICATIONS

International Search Report and Written Opinion for International Application No. PCT/US2019/036141, dated Aug. 9, 2019, 11 pages.
(Continued)

*Primary Examiner* — Steven M Cernoch
(74) *Attorney, Agent, or Firm* — Foley & Lardner LLP

(57) ABSTRACT

A fire suppression system includes a tank configured to contain fire suppressant agent, a cartridge configured to contain pressurized expellant gas, the cartridge including an electrically-conductive section, an actuator coupled to the tank and selectively coupled to the cartridge, and a cartridge monitoring system coupled to the actuator. The actuator is configured to selectively supply the pressurized expellant gas from the cartridge to the tank such that the fire suppressant agent is dispensed from the tank. The cartridge monitoring system includes (a) a first contact and a second contact configured to engage the electrically-conductive section of the cartridge when the cartridge is coupled to the actuator and (b) an electrical interpreter coupled to the first contact and the second contact and configured to determine if the electrically-conductive section of the cartridge is engaging the first contact and the second contact to form a closed circuit.

16 Claims, 10 Drawing Sheets

(51) Int. Cl.
*A62C 35/13* (2006.01)
*A62C 37/50* (2006.01)

(58) Field of Classification Search
USPC ..... 439/320
See application file for complete search history.

(56) References Cited

U.S. PATENT DOCUMENTS

| | | | |
|---|---|---|---|
| 8,378,834 | B1 | 2/2013 | Glaub et al. |
| 8,997,885 | B2 | 4/2015 | Krueger |
| 2013/0048319 | A1 | 2/2013 | Glaub et al. |
| 2013/0240222 | A1 | 9/2013 | Krueger |

FOREIGN PATENT DOCUMENTS

| | | | |
|---|---|---|---|
| CN | 103354759 | A | 10/2013 |
| CN | 103429500 | A | 12/2013 |
| CN | 203677827 | U | 7/2014 |
| CN | 104780981 | A | 7/2015 |
| CN | 106964096 | A | 7/2017 |
| CN | 207286427 | U | 5/2018 |
| WO | WO-2016/196104 | A1 | 12/2016 |
| WO | WO-2018/112385 | | 6/2018 |

OTHER PUBLICATIONS

English translation of Office action received for Chinese Application No. 201980052308.1, dated Sep. 8, 2021, 6 pages.

* cited by examiner

CARTRIDGE MONITORING SYSTEM

CROSS-REFERENCE TO RELATED PATENT APPLICATION

This application claims the benefit of U.S. Provisional Patent Application No. 62/682,506, filed Jun. 8, 2018, which is incorporated herein by reference in its entirety.

BACKGROUND

Fire suppression systems are commonly used to protect an area and objects within the area from fire. Fire suppression systems can be activated manually or automatically in response to an indication that a fire is present nearby (e.g., an increase in ambient temperature beyond a predetermined threshold value, etc.). Once activated, fire suppression systems spread a fire suppression agent throughout the area. The fire suppressant agent then extinguishes or controls (e.g., prevents the growth of) the fire.

SUMMARY

At least one embodiment relates to a fire suppression system. The fire suppression system includes a tank configured to contain fire suppressant agent, a cartridge configured to contain pressurized expellant gas, the cartridge including an electrically-conductive section, an actuator coupled to the tank and selectively coupled to the cartridge, and a cartridge monitoring system coupled to the actuator. The actuator is configured to selectively supply the pressurized expellant gas from the cartridge to the tank such that the fire suppressant agent is dispensed from the tank. The cartridge monitoring system includes (a) a first contact and a second contact configured to engage the electrically-conductive section of the cartridge when the cartridge is coupled to the actuator and (b) an electrical interpreter coupled to the first contact and the second contact and configured to determine if the electrically-conductive section of the cartridge is engaging the first contact and the second contact to form a closed circuit.

Another embodiment relates to an actuator including a receiver defining a recess configured to receive a neck of a cartridge containing a pressurized gas, an activation mechanism configured to selectively release the pressurized gas from the cartridge such that the pressurized gas flows through the recess and out of the actuator, and a contact configured to engage the neck when the neck is inserted into the recess. The contact is configured to electrically couple the neck to an electrical interpreter when the contact engages the neck.

Another embodiment relates to a method of monitoring installation of a cartridge. The method includes providing an actuator configured to be coupled to the cartridge, positioning a first contact and a second contact such that a conductive portion of the cartridge engages both the first contact and the second contact when the cartridge is coupled to the actuator, applying a voltage across the first contact and the second contact, measuring a current that passes through the first contact and the second contact, determining if the measured current is below a threshold current, and providing a notification indicating that the cartridge is not coupled to the actuator in response a determination that the measured current is below the threshold current. The actuator is configured to control a flow of material from the cartridge when the cartridge is coupled to the actuator.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Figure 1:
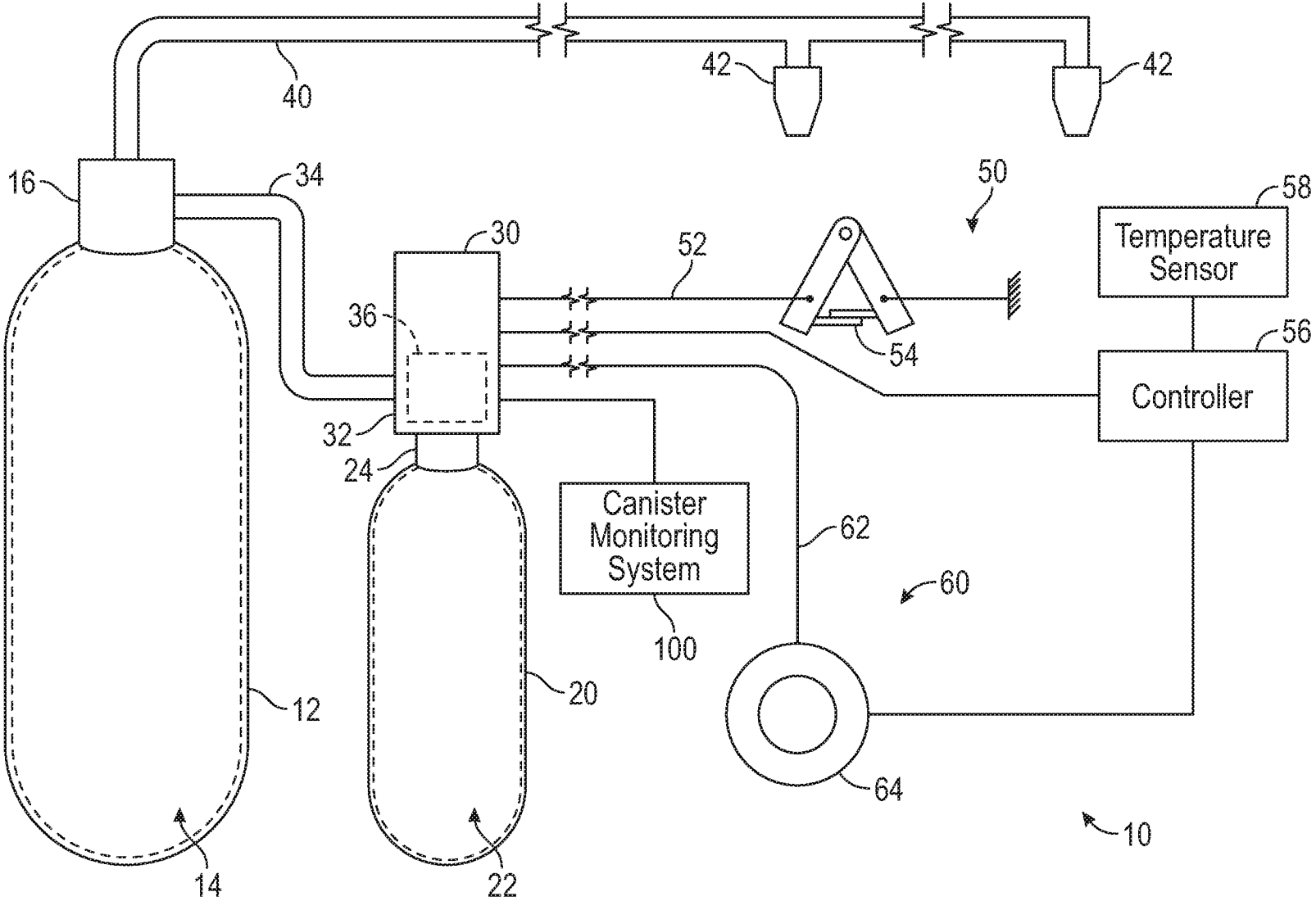
FIG. 1 is a schematic of a fire suppression system, according to an exemplary embodiment.

Before turning to the figures, which illustrate the exemplary embodiments in detail, it should be understood that the present disclosure is not limited to the details or methodology set forth in the description or illustrated in the figures. It should also be understood that the terminology used herein is for the purpose of description only and should not be regarded as limiting.

Overview

Some fire suppression systems (e.g., chemical fire suppression systems) include a tank of fire suppressant agent, a cartridge of expellant gas, and an actuator. The actuator controls the flow of expellant gas to the tank. When the expellant gas flows freely to the tank, the expellant gas forces the fire suppressant agent out of the tank and onto and/or around the fire. Installation of the cartridge into the system is often performed near the end of the commissioning process for a fire suppression system. Accordingly, there is a potential for the operator commissioning the system to forget to install the cartridge. Without the cartridge, the fire suppression system will not function.

According to an exemplary embodiment, a fire suppression system includes a tank filled with a fire suppressant agent and a cartridge filled with pressurized expellant gas. An actuator is fluidly coupled to the tank, and the cartridge may be selectively coupled to the actuator. An automatic activation system, such as a temperature sensitive fusible link, and a manual activation system, such as a manual button or lever, are configured to provide an indication to the actuator when a fire occurs nearby. In response to receiving such an indication, the actuator is configured to fluidly couple the cartridge to the tank. This permits expellant gas from the cartridge to force the fire suppressant agent out of the tank. The fire suppressant agent then flows to a series of nozzles that direct the fire suppressant agent onto the fire, suppressing the fire.

In some circumstances, such as during the initial installation of the fire suppression system or when resetting the fire suppression system after operation, it is necessary to install the cartridge of expellant gas. However, this step often occurs near the end of the setup process, and there may be some potential for the operator to forget to install the cartridge. Without the cartridge being installed properly, the fire suppression system will not function. To avoid this, the fire suppression system includes a cartridge monitoring system that is configured to determine if a cartridge is fully engaged with the actuator.

The cartridge has a neck defining a male threaded section that engages a corresponding female threaded section of the actuator. To couple the cartridge to the actuator, the male threaded section is inserted into the female threaded section, and the cartridge is rotated until fully engaged. The neck of the cartridge is made from an electrically-conductive material, such as steel or aluminum. At least one electrical contact extends through the female threaded section of the actuator and engages the male threaded section of the cartridge. In some embodiments, the portion of the actuator that receives the neck of the cartridge is conductive and acts as the second contact. An electrical interpreter and a power source provide a voltage across the contacts. The contacts are normally electrically isolated from one another such that when the cartridge is removed, a negligible amount of current flows between them. When the cartridge is fully engaged with the actuator, however, the contacts engage the electrically-conductive neck, and current flows through the first contact and the neck and out through the second contact. The electrical interpreter monitors this current. When the current indicates an open circuit across the contacts, the electrical interpreter activates an alarm or provides another type of indication, notifying the operator that the cartridge is not yet fully seated or that the cartridge is not yet present.

Fire Suppression System

Referring to FIG. 1, a fire suppression system 10 is shown according to an exemplary embodiment. In one embodiment, the fire suppression system 10 is a chemical fire suppression system. The fire suppression system 10 is configured to dispense or distribute a fire suppressant agent onto and/or nearby a fire, extinguishing the fire and preventing the fire from spreading. The fire suppression system 10 may be used alone or in combination with other types of fire suppression systems (e.g., a building sprinkler system, a handheld fire extinguisher, etc.). In some embodiments, multiple fire suppression systems 10 are used in combination with one another to cover a larger area (e.g., each in different rooms of a building).

The fire suppression system 10 may be used in a variety of different applications. Different applications may require different types of fire suppressant agent and different levels of mobility. The fire suppression system 10 is usable with a variety of different fire suppressant agents, such as powders, liquids, foams, or other fluid or flowable materials. The fire suppression system 10 may be used in a variety of stationary applications. By way of example, the fire suppression system 10 is usable in kitchens (e.g., for oil or grease fires, etc.), in libraries, in data centers (e.g., for electronics fires, etc.), at filling stations (e.g., for gasoline or propane fires, etc.), or in other stationary applications. Alternatively, the fire suppression system 10 may be used in a variety of mobile applications. By way of example, the fire suppression system 10 may be incorporated into land-based vehicles (e.g., racing vehicles, forestry vehicles, construction vehicles, agricultural vehicles, mining vehicles, passenger vehicles, refuse vehicles, etc.), airborne vehicles (e.g., jets, planes, helicopters, etc.), or aquatic vehicles, (e.g., ships, submarines, etc.).

Referring again to FIG. 1, the fire suppression system 10 includes a fire suppressant tank 12 (e.g., a vessel, container, vat, drum, tank, canister, cartridge, or can, etc.). The fire suppressant tank 12 defines an internal volume 14 filled (e.g., partially, completely, etc.) with fire suppressant agent. In some embodiments, the fire suppressant agent is normally not pressurized (e.g., is near atmospheric pressure). The fire suppressant tank 12 includes an exchange section, shown as neck 16. The neck 16 permits the flow of expellant gas into the internal volume 14 and the flow of fire suppressant agent out of the internal volume 14 so that the fire suppressant agent may be supplied to a fire.

The fire suppression system 10 further includes a cartridge 20 (e.g., a vessel, container, vat, drum, tank, canister, cartridge, or can, etc.). The cartridge 20 defines an internal volume 22 configured to contain a volume of pressurized expellant gas. The expellant gas may be an inert gas. In some embodiments, the expellant gas is air, carbon dioxide, or nitrogen. The cartridge 20 includes an outlet portion or outlet section, shown as neck 24. The neck 24 defines an outlet fluidly coupled to the internal volume 22. Accordingly, the expellant gas may leave the cartridge 20 through the neck 24. The cartridge 20 may be rechargeable or disposable after use. In some embodiments where the cartridge 20 is rechargeable, additional expellant gas may be supplied to the internal volume 22 through the neck 24.

The fire suppression system 10 further includes a valve, puncture device, or activator assembly, shown as actuator 30. The actuator 30 includes an adapter, shown as receiver 32, that is configured to receive the neck 24 of the cartridge 20. The neck 24 is selectively coupled to the receiver 32 (e.g., through a threaded connection, etc.). Decoupling the cartridge 20 from the actuator 30 facilitates removal and replacement of the cartridge 20 when the cartridge 20 is depleted. The actuator 30 is fluidly coupled to the neck 16 of the fire suppressant tank 12 through a conduit or pipe, shown as hose 34.

The actuator 30 includes an activation mechanism 36 configured to selectively fluidly couple the internal volume 22 to the neck 16. In some embodiments, the activation mechanism 36 includes one or more valves that selectively fluidly couple the internal volume 22 to the hose 34. The valves may be mechanically, electrically, manually, or otherwise actuated. In some such embodiments, the neck 24 includes a valve that selectively prevents the expellant gas from flowing through the neck 24. Such a valve may be manually operated (e.g., by a lever or knob on the outside of the cartridge 20, etc.) or may open automatically upon engagement of the neck 24 with the actuator 30. Such a valve facilitates removal of the cartridge 20 prior to depletion of the expellant gas. In other embodiments, the cartridge 20 is sealed, and the activation mechanism 36 includes a pin, knife, nail, or other sharp object that the actuator 30 forces into contact with the cartridge 20. This punctures the outer surface of the cartridge 20, fluidly coupling the internal volume 22 with the actuator 30. In some embodiments, the activation mechanism 36 punctures the cartridge 20 only when the actuator 30 is activated. In some such embodiments, the activation mechanism 36 omits any valves that control the flow of expellant gas to the hose 34. In other embodiments, the activation mechanism 36 automatically punctures the cartridge 20 as the neck 24 engages the actuator 30.

Once the actuator 30 is activated and the cartridge 20 is fluidly coupled to the hose 34, the expellant gas from the cartridge 20 flows freely through the neck 24, the actuator 30, and the hose 34 and into the neck 16. The expellant gas forces fire suppressant agent from the fire suppressant tank 12 out through the neck 16 and into a conduit or hose, shown as pipe 40. In one embodiment, the neck 16 directs the expellant gas from the hose 34 to a top portion of the internal volume 14. The neck 16 defines an outlet (e.g., using a syphon tube, etc.) near the bottom of the fire suppressant tank 12. The pressure of the expellant gas at the top of the internal volume 14 forces the fire suppressant agent to exit through the outlet and into the pipe 40. In other embodiments, the expellant gas enters a bladder within the fire suppressant tank 12, and the bladder presses against the fire suppressant agent to force the fire suppressant agent out through the neck 16. In yet other embodiments, the pipe 40 and the hose 34 are coupled to the fire suppressant tank 12 at different locations. By way of example, the hose 34 may be coupled to the top of the fire suppressant tank 12, and the pipe 40 may be coupled to the bottom of the fire suppressant tank 12. In some embodiments, the fire suppressant tank 12 includes a burst disk that prevents the fire suppressant agent from flowing out through the neck 16 until the pressure within the internal volume 14 exceeds a threshold pressure. Once the pressure exceeds the threshold pressure, the burst disk ruptures, permitting the flow of fire suppressant agent. Alternatively, the fire suppressant tank 12 may include a valve, a puncture device, or another type of opening device or activator assembly that is configured to fluidly couple the internal volume 14 to the pipe 40 in response to the pressure within the internal volume 14 exceeding the threshold pressure. Such an opening device may be configured to activate mechanically (e.g., the force of the pressure causes the opening device to activate, etc.) or the opening device may include a separate pressure sensor in communication with the internal volume 14 that causes the opening device to activate.

The pipe 40 is fluidly coupled to one or more outlets or sprayers (e.g., nozzles, sprinkler heads, etc.), shown as nozzles 42. The fire suppressant agent flows through the pipe 40 and to the nozzles 42. The nozzles 42 each define one or more apertures, through which the fire suppressant agent exits, forming a spray of fire suppressant agent that covers a desired area. The sprays from the nozzles 42 then suppress or extinguish fire within that area. The apertures of the nozzles 42 may be shaped to control the spray pattern of the fire suppressant agent leaving the nozzles 42. The nozzles 42 may be aimed such that the sprays cover specific points of interest (e.g., a specific piece of restaurant equipment, a specific component within an engine compartment of a vehicle, etc.). The nozzles 42 may be configured such that all of the nozzles 42 activate simultaneously, or the nozzles 42 may be configured such that only the nozzles 42 near the fire are activated.

The fire suppression system 10 further includes an automatic activation system 50 that controls the activation of the actuator 30. The automatic activation system 50 is configured to monitor one or more conditions and determine if those conditions are indicative of a nearby fire. Upon detecting a nearby fire, the automatic activation system 50 activates the actuator 30, causing the fire suppressant agent to leave the nozzles 42 and extinguish the fire.

In some embodiments, the actuator 30 is controlled mechanically. As shown in FIG. 1, the automatic activation system 50 includes a mechanical system including a tensile member (e.g., a rope, a cable, etc.), shown as cable 52, that imparts a tensile force on the actuator 30. Without this tensile force, the actuator 30 will activate. The cable 52 is coupled to a fusible link 54, which is in turn coupled to a stationary object (e.g., a wall, the ground, etc.). The fusible link 54 includes two plates that are held together with a solder alloy having a predetermined melting point. A first plate is coupled to the cable 52, and a second plate is coupled to the stationary object. When the ambient temperature surrounding the fusible link 54 exceeds the melting point of the solder alloy, the solder melts, allowing the two plates to separate. This releases the tension on the cable 52, and the actuator 30 activates. In other embodiments, the automatic activation system 50 is another type of mechanical system that imparts a force on the actuator 30 to activate the actuator 30. The automatic activation system 50 may include linkages, motors, hydraulic or pneumatic components (e.g., pumps, compressors, valves, cylinders, hoses, etc.), or other types of mechanical components configured to activate the actuator 30. Some parts of the automatic activation system 50 (e.g., a compressor, hoses, valves, and other pneumatic components, etc.) may be shared with other parts of the fire suppression system 100 (e.g., the manual activation system 60) or vice versa.

The actuator 30 may additionally or alternatively be configured to activate in response to receiving an electrical signal from the automatic activation system 50. Referring to FIG. 1, the automatic activation system 50 includes a controller 56 that monitors signals from one or more fire detectors or sensors, shown as temperature sensor 58 (e.g., thermocouples, resistance temperature detectors, etc.). The controller 56 may use the signals from the temperature sensor 58 to determine if an ambient temperature has exceeded a threshold temperature. Upon determining that the ambient temperature has exceeded the threshold temperature, the controller 56 provides an electrical signal to the actuator 30. The actuator 30 then activates in response to receiving the electrical signal.

The fire suppression system 10 further includes a manual activation system 60 that controls the activation of the actuator 30. The manual activation system 60 is configured to activate the actuator 30 in response to an input from an operator. The manual activation system 60 may be included instead of or in addition to the automatic activation system 50. Both the automatic activation system 50 and the manual activation system 60 may activate the actuator 30 independently. By way of example, the automatic activation system 50 may activate the actuator 30 regardless of any input from the manual activation system 60, and vice versa.

As shown in FIG. 1, the manual activation system 60 includes a mechanical system including a tensile member (e.g., a rope, a cable, etc.), shown as cable 62, coupled to the actuator 30. The cable 62 is coupled to a human interface device (e.g., a button, a lever, a switch, a knob, a pull ring, etc.), shown as button 64. The button 64 is configured to impart a tensile force on the cable 62 when pressed, and this tensile force is transferred to the actuator 30. The actuator 30 activates upon experiencing the tensile force. In other embodiments, the manual activation system 60 is another type of mechanical system that imparts a force on the actuator 30 to activate the actuator 30. The manual activation system 60 may include linkages, motors, hydraulic or pneumatic components (e.g., pumps, compressors, valves, cylinders, hoses, etc.), or other types of mechanical components configured to activate the actuator 30.

The actuator 30 may additionally or alternatively be configured to activate in response to receiving an electrical signal from the manual activation system 60. As shown in FIG. 1, the button 64 is operably coupled to the controller 56. The controller 56 may be configured to monitor the status of a human interface device or user input device (e.g., engaged, disengaged, etc.). Upon determining that the human interface device is engaged, the controller provides an electrical signal to activate the actuator 30. By way of example, the controller 56 may be configured to monitor a signal from the button 64 to determine if the button 64 is pressed. Upon detecting that the button 64 has been pressed, the controller 56 sends an electrical signal to the actuator 30 to activate the actuator 30.

The automatic activation system 50 and the manual activation system 60 are shown to activate the actuator 30 both mechanically (e.g., though application of a tensile force through cables, through application of a pressurized liquid, through application of a pressurized gas, etc.) and electrically (e.g., by providing an electrical signal). It should be understood, however, that the automatic activation system 50 and/or the manual activation system 60 may be configured to activate the actuator 30 solely mechanically, solely electrically, or through some combination of both. By way of example, the automatic activation system 50 may omit the controller 56 and activate the actuator 30 based on the input from the fusible link 54. By way of another example, the automatic activation system 50 may omit the fusible link 54 and activate the actuator 30 using an input from the controller 56.

Cartridge Monitoring System

Figure 2:
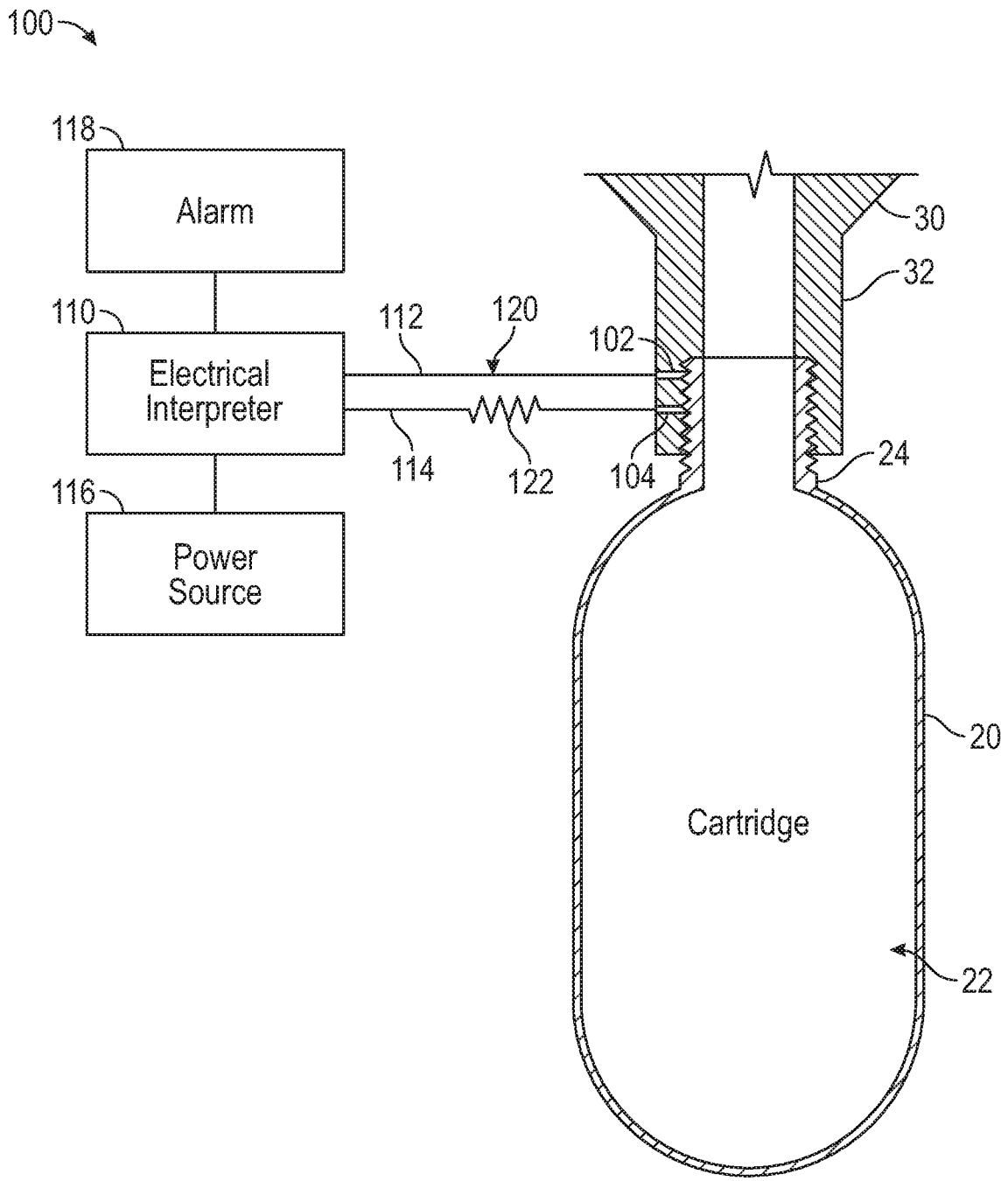
FIG. 2 is a schematic of a cartridge monitoring system of the fire suppression system of FIG. 1.

Referring to FIGS. 1 and 2, the fire suppression system 10 further includes a cartridge monitoring system 100. The cartridge monitoring system 100 is configured to detect whether or not the cartridge 20 is engaged with the actuator 30. In response to detecting that the cartridge 20 is not engaged with the actuator 30, the cartridge monitoring system 100 provides a notification to an operator. The cartridge monitoring system 100 prevents accidental omission of the cartridge 20 from the fire suppression system 10, which would prevent the fire suppression system 10 from operating properly.

Referring to FIG. 2, the cartridge monitoring system 100 includes a pair of electrical contacts, shown as contact 102 and contact 104, coupled to the actuator 30. The contact 102 and the contact 104 extend through the receiver 32 of the actuator 30. The contact 102 and the contact 104 are positioned to engage the neck 24 of the cartridge 20 when the cartridge 20 is fully engaged with the receiver 32. In some embodiments, the neck 24 is made from a material that is electrically-conductive (e.g., steel, aluminum, brass, etc.). In other embodiments, the neck 24 is made from a non-conductive or insulative material, and an additional conductor, such as a conductive sleeve, is added to the neck 24. Accordingly, when the neck 24 is fully engaged with the receiver 32, the contact 102 is electrically coupled to the contact 104 through and electrically-conductive portion of the neck 24.

The cartridge monitoring system 100 further includes a controller or electrical circuit, shown as electrical interpreter 110. The electrical interpreter 110 is configured to control the operation of the other elements of the cartridge monitoring system 100. The electrical interpreter 110 is electrically coupled to the contact 102 through a conductor or lead, shown as wire 112, and to the contact 104 through a conductor or lead, shown as wire 114. The wire 112 and the wire 114 facilitate placement of the electrical interpreter 110 remotely from the actuator 30. The wire 112 and the wire 114 may each include one or more individual conductors. In other embodiments, the wire 112 and the wire 114 are omitted, and the electrical interpreter 110 is directly coupled to the contact 102 and the contact 104. In some embodiments, one of the wires is directly connected to the receiver 32, and the receiver 32 acts as one of the contacts.

In some embodiments, the electrical interpreter 110 is or includes a controller. The controller may include a processor and a memory. By way of example, the controller may be configured to monitor the status of an input (e.g., the current flowing through the contact 102 and the contact 104) and issue a command to another component (e.g., the alarm 118) based on the status of the input. In other embodiments, the controller is omitted, and the electrical interpreter 110 includes basic electrical components. By way of example, the electrical interpreter 110 may be a series of wires that route electrical energy from a battery (e.g., the power source 116) to a light source (e.g., the alarm 118) when a switch coupled to the electrical interpreter 110 (e.g., the circuit 120) is closed (e.g., the neck 24 engages the contact 102 and the contact 104).

The electrical interpreter 110 is operably coupled to a power source 116. The power source 116 is configured to generate or transfer electrical energy to the electrical interpreter 110 to power the cartridge monitoring system 100. The power source 116 may be an alternating current (AC) power source or a direct current (DC) power source. By way of example, the power source 116 can be a cable that transfers electrical energy from an electrical grid to the electrical interpreter 110. By way of another example, the power source 116 may be a battery or capacitor.

The electrical interpreter 110 is also operably coupled to a notification device, indicator, or notifier, shown as alarm 118. The alarm 118 is configured to provide a notification (e.g., information, an indication, etc.) to an operator. The alarm 118 may be or include a light source (e.g., a light emitting diode (LED), an incandescent bulb, etc.) that provides light as a notification. The alarm 118 may be or include a speaker that emits a sound as a notification. The alarm 118 may be or include a display (e.g., a liquid crystal display, a dot matrix display, etc.) that displays a message as a notification. The alarm 118 may be or include a motor that rotates a weight to vibrate or that moves a flag or some other object between two positions as a notification. The alarm 118 may be or include a controller operatively coupled to a network and configured to provide a text message, a phone call, an e-mail, or another type of notification to a user device (e.g., a smartphone, a laptop, etc.) over the network. The alarm 118 may also communicate with a larger network or system (e.g., a building maintenance system) and provide information (e.g., a notification) to that system. The system may then store that information and/or act in response to that information (e.g., provide a notification to a user of the larger system).

The electrical interpreter 110 is configured to determine if a circuit is open or closed between the contact 102 and the contact 104. Specifically, using electrical energy from the power source 116, the electrical interpreter 110 is configured to apply a voltage across the wire 112 and the wire 114 and, accordingly, across the contact 102 and the contact 104.

When the neck 24 is fully engaged with the receiver 32, the neck 24 engages both the contact 102 and the contact 104. This completes a circuit 120 that includes the electrical interpreter 110, the wire 112, the contact 102, the conductive portion of the neck 24, the contact 104, and the wire 114. Accordingly, a current flows through the circuit 120. The electrical interpreter 110 monitors this current, and when the current is above a threshold current (e.g., indicative of a closed circuit), the electrical interpreter 110 does not activate the alarm 118. The electrical interpreter 110 may activate the alarm 118 when the current is below the threshold current (e.g., indicative of an open circuit), indicating that the cartridge 20 is not coupled to the actuator 30 (e.g., not fully engaged). Alternatively, when the supplied current is above the threshold current, the electrical interpreter 110 may activate the alarm 118 to provide a notification to the operator that the cartridge 20 is fully engaged.

When the cartridge 20 is disengaged from the receiver 32, the neck 24 is disengaged from both the contact 102 and the contact 104. Accordingly, the contact 102 and the contact 104 are electrically isolated, and no current or a negligible current flows through the contact 102 and the contact 104. The electrical interpreter 110 monitors the supplied current, and when the current is below the threshold current (e.g., indicative of an open circuit), the electrical interpreter 110 activates the alarm 118 to provide a notification to the operator that the cartridge 20 is not fully engaged. Such a notification may be provided when the cartridge 20 is only partially engaged with the actuator 30 (e.g., when only a single thread of the neck 22 engages the receiver 32) and/or when the cartridge 20 is not engaged with the actuator 30 at all (e.g., is not present, etc.). The cartridge monitoring system 100 may provide different notifications for different levels of engagement (e.g., fully engaged, partially engaged, etc.). By way of example, one notification may be illuminating a first light, and the other notification may be illuminating a second light.

Alternatively, the electrical interpreter 110 may act as a constant current source that supplies a variable voltage across the wire 112 and the wire 114. The constant current source controls the voltage such that a constant current is supplied through the wire 112 and the wire 114. In such an embodiment, the electrical interpreter 110 may be configured to not activate the alarm 118 when a closed circuit is detected and to activate the alarm 118 when an open circuit is detected.

In one embodiment, the contact 102 and the contact 104 are made from gold or are gold plated such that the surfaces of the contact 102 and the contact 104 that engage the neck 24 are gold. Gold is generally considered to be a good conductor and is inherently corrosion resistant. Corrosion buildup on the contact 102 and the contact 104 could interfere with the electrical connections between the contact 102, the contact 104, and the conductive portion of the neck 24, causing the electrical interpreter 110 to falsely determine that the cartridge 20 is not fully engaged with the actuator 30. The corrosion resistance of gold is particularly desirable in embodiments where the contact 102 and the contact 104 are made from a different material than the neck 24, as contact between dissimilar metals may accelerate corrosion. In other embodiments, the contact 102 and the contact 104 are made from other materials (e.g., copper, brass, aluminum, steel, carbon, etc.).

In some embodiments, an electrically resistive element (e.g., a resistor or group of resistors), shown as resistive element 122, is included in series along the length of the wire 112 and/or the wire 114. Accordingly, the resistive element 122 is part of the circuit 120. In some embodiments, the resistive element 122 includes a single resistor. In other embodiments, the resistive element 122 includes multiple resistors in parallel or series. The resistive element 122 may be sized (e.g., the resistance of the resistive element 122 may be selected, resistors may be added or removed, etc.) to adjust the current that flows through the circuit 120 or the voltage drop across the resistive element 122 when the cartridge 20 is fully engaged. Increasing the resistance of the resistive element 122 decreases the current flowing through the circuit 120 for a given applied voltage. Reducing the current flowing through the circuit 120 may decrease the amount of electrical energy that is converted and given off as heat, potentially preventing damage to components of the circuit 120 and reducing wasted energy. Alternatively, in embodiments where the electrical interpreter 110 supplies a constant current, adjusting the resistance of the resistive element 122 may control the voltage drop across the resistive element 122.

In some embodiments, the circuit 120 includes components (e.g., switches, etc.) that are configured to vary the resistance of the resistive element 122 in response to certain events. The events may include a detection of an open circuit (e.g., caused by a broken wire, etc.), detection of a ground fault, activation of a manual device (e.g., a push button, etc.), activation of an automatic device such as a sensor (e.g., a temperature or heat sensor, an optical sensor, etc.), or other events. The circuit 120 may vary the resistance of a single resistor, add or remove resistors to or from the resistive element 122, or change the arrangement of resistors within the resistive element 122 to vary the resistance of the resistive element 122. Under nominal conditions (e.g., the cartridge 20 is fully engaged with the actuator 30 and no faults are present, etc.), the resistive element 122 has a predetermined resistance (e.g., 4,700 Ohms, etc.). For each event that occurs, the circuit 120 is configured to change the resistance of the resistive element 122 to a different predetermined resistance or to within a different predetermined resistance band that corresponds specifically to that event.

The electrical interpreter 110 is configured to measure the resistance of the resistive element 122. By way of example, the electrical interpreter 110 may include a microprocessor having an analog/digital interface that measures the voltage drop across the resistive element 122. In embodiments where a constant current is supplied to the circuit 120, the voltage drop across the resistive element 122 and the supplied current may be used to determine the resistance of the resistive element 122. In embodiments where the voltage supplied across the circuit 120 is known and the resistance of each component other than the resistive element 122 is known, the current through the circuit 120 may be used to determine the resistance of the resistive element 122. By way of example, a secondary resistor having a known resistance may be added to the circuit 120 in series with the resistive element 122. The analog/digital interface may measure the voltage across the secondary resistor to determine the current through the circuit 120. Once the resistance of the resistive element 122 has been determined, the electrical interpreter 110 may compare the measured resistance of the resistive element 122 to a listing of the predetermined resistances or predetermined resistance bands (e.g., stored in a memory of a controller) corresponding to each event to identify what event is currently occurring. The electrical interpreter 110 may be configured to then perform an action (e.g., provide a notification through the alarm 118, etc.) based on the occurrence of the event.

Figure 3:
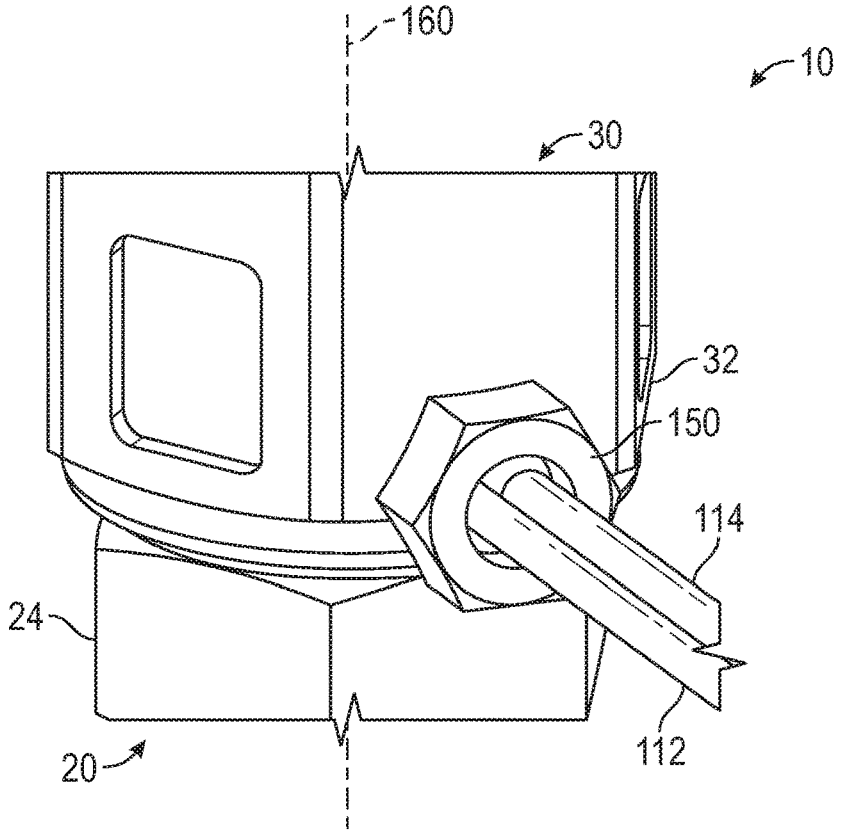
FIG. 3 is a perspective view of a connection between an actuator and a cartridge of a fire suppression system, according to an exemplary embodiment.
Figure 4:
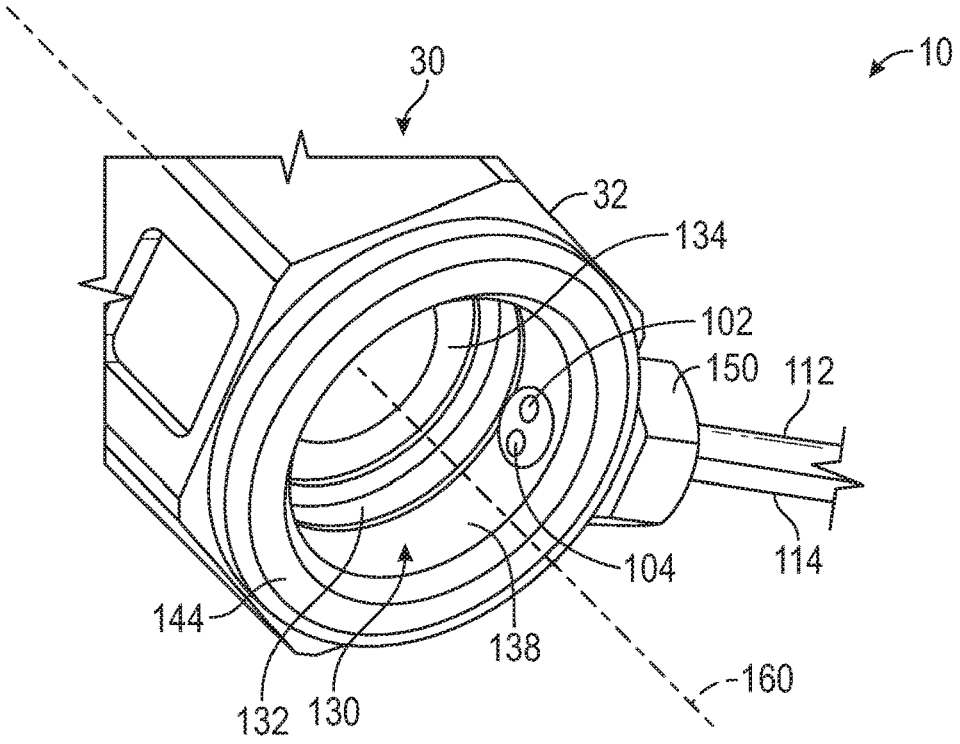
FIG. 4 is a perspective view of the actuator of FIG. 3.
Figure 5:
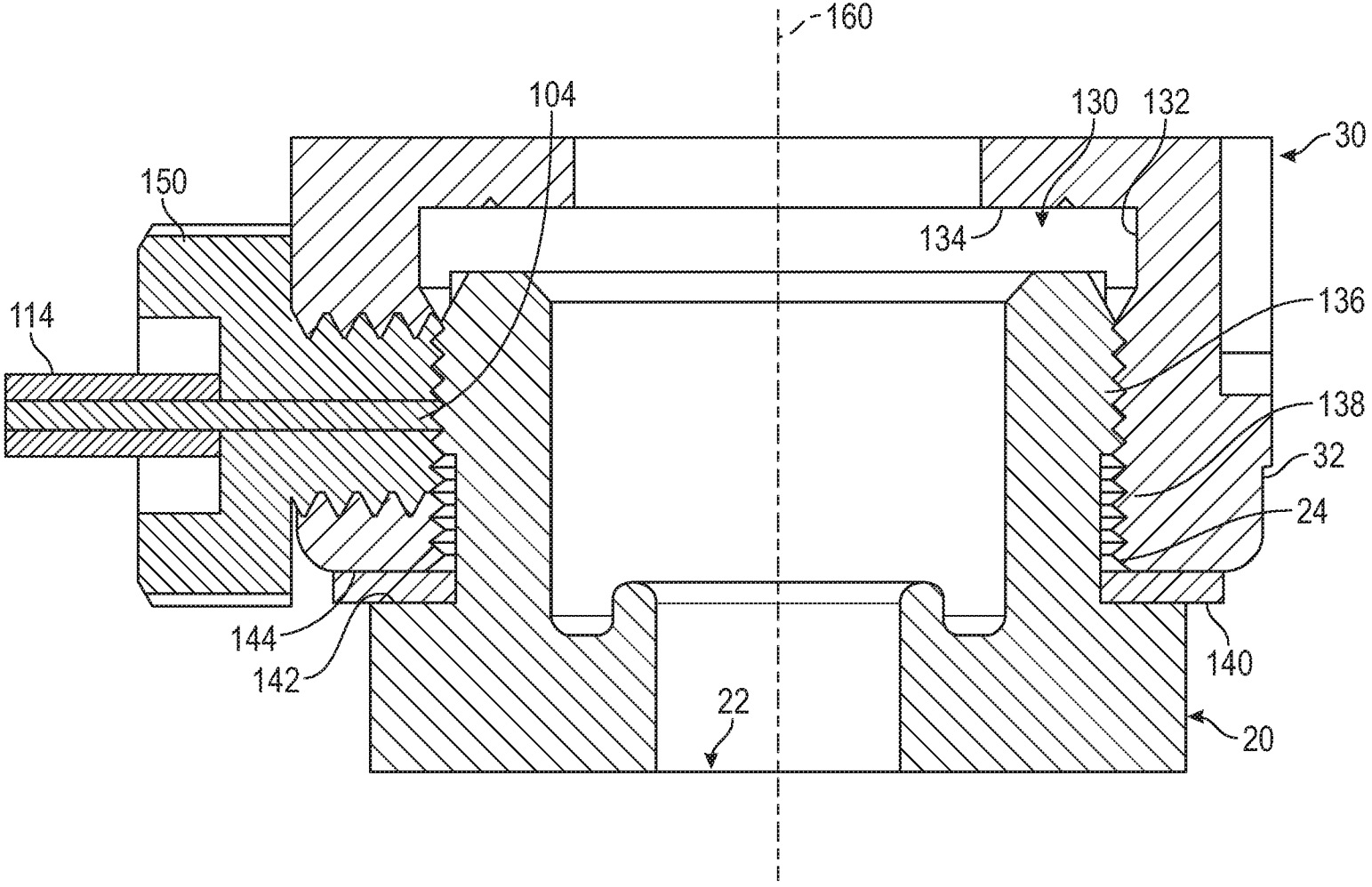
FIG. 5 is a section view of the connection between the actuator and the cartridge of FIG. 3.
Figure 6:
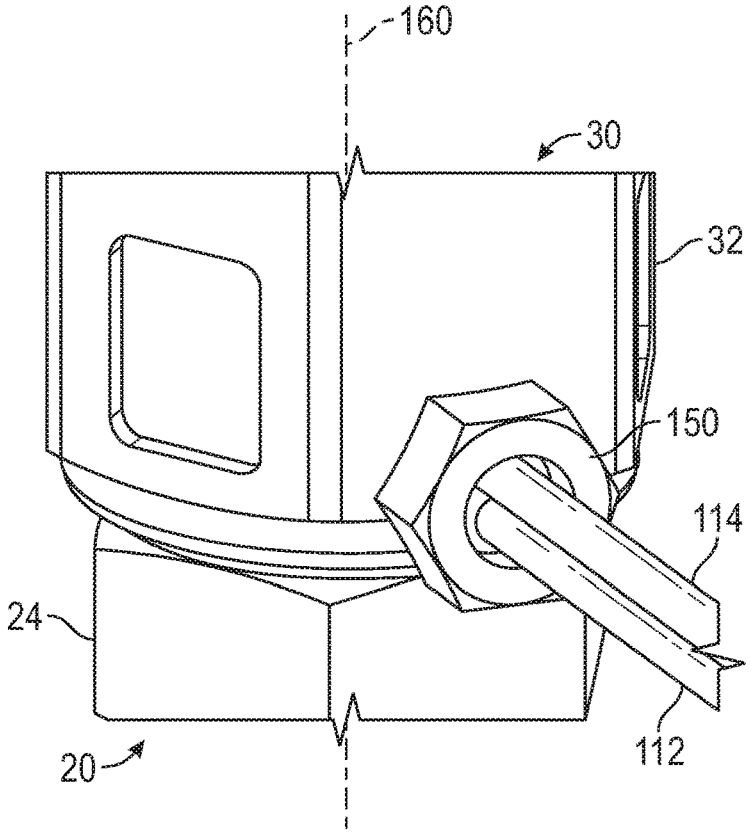
FIG. 6 is a perspective view of a connection between an actuator and a cartridge of a fire suppression system, according to another exemplary embodiment.
Figure 7:
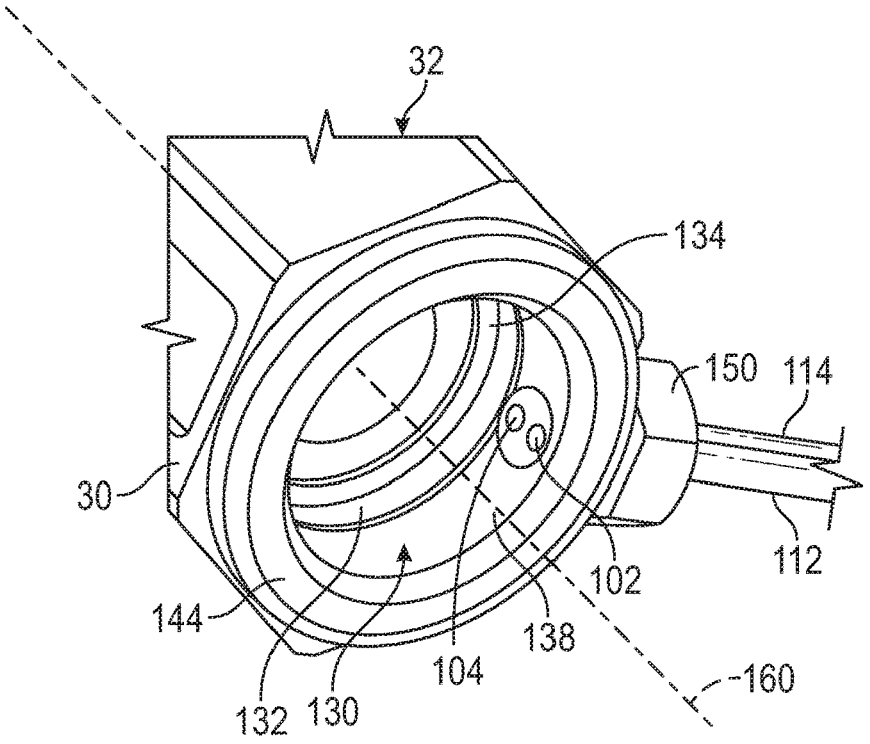
FIG. 7 is a perspective view of the actuator of FIG. 6.
Figure 8:
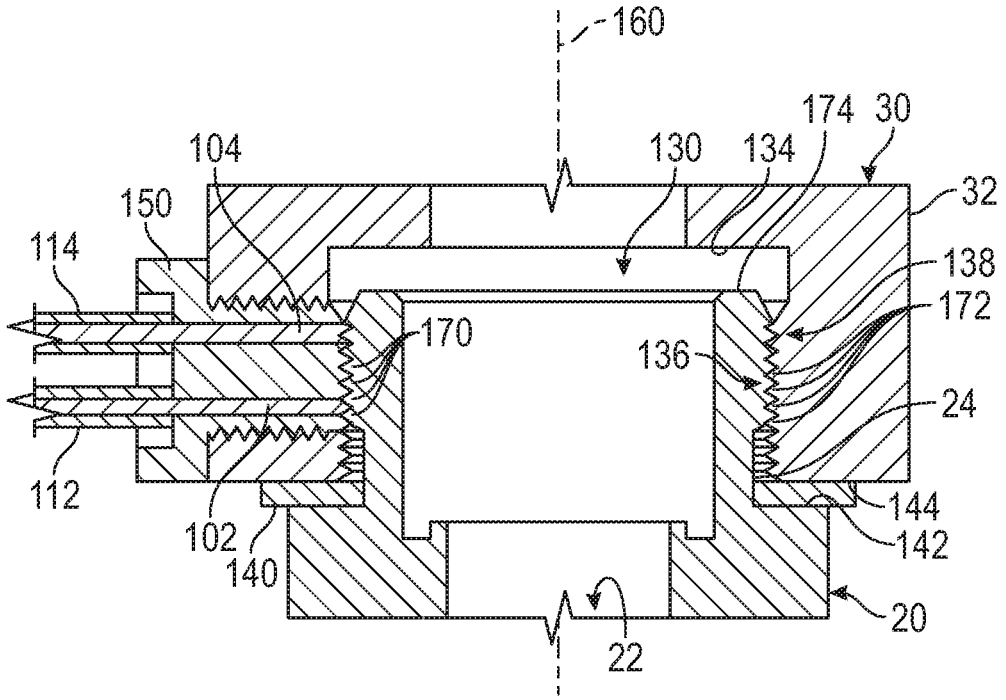
FIGS. 8-11 are section views of a connection between an actuator and a cartridge of a fire suppression system, according to various exemplary embodiments.
Figure 9:
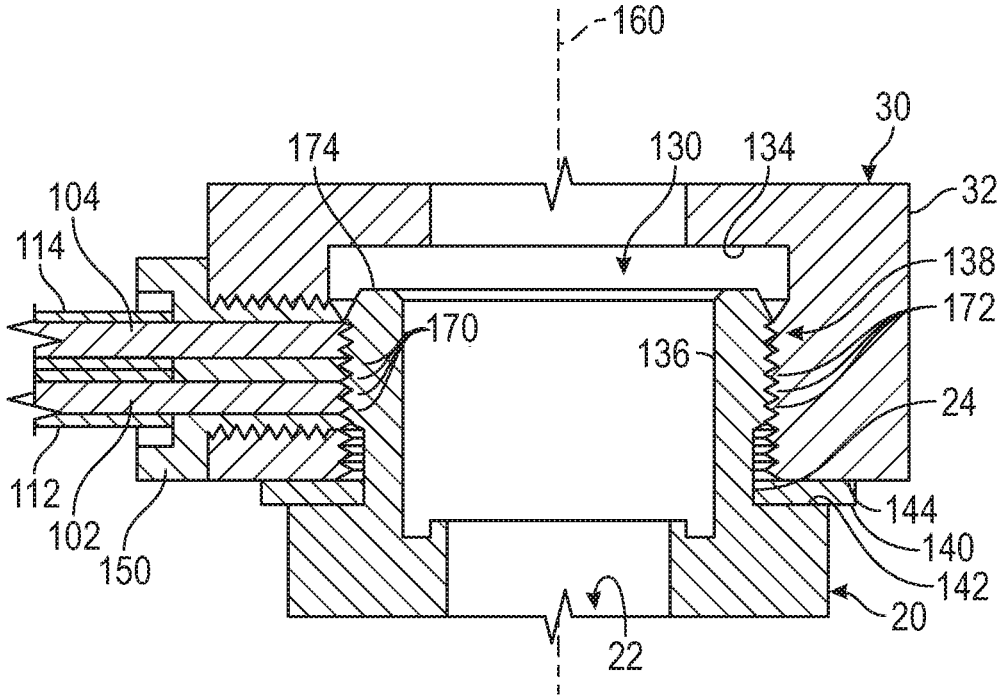

Referring to FIGS. 3-11, the connection between the neck 24 and the receiver 32 is shown according to various exemplary embodiments. The receiver 32 defines a passage, aperture, or recess 130 that receives the neck 24 of the cartridge 20. The recess 130 is defined between an annular side wall 132 and a flat end wall 134 of the receiver 32. The recess 130 is fluidly coupled to the interior of the actuator 30 such that the expellant gas flows from the internal volume 22 of the cartridge 20 and through the recess 130 prior to entering the hose 34. The neck 24 includes a threaded section 136 having a series of external male threads, and the receiver 32 includes a threaded section 138 having a series of corresponding internal female threads. The threaded section 138 of the receiver 32 is defined by the annular side wall 132. FIGS. 3, 5, and 7 illustrate the threaded section 136 and the threaded section 138 prior to cutting the threads, however the individual threads (e.g., the threads 170 and the threads 172) are shown in FIGS. 8-11.

In FIGS. 3, 5, and 7, the neck 24 is fully engaged with the receiver 32. To become fully engaged, the neck 24 is tightened (e.g., rotated) into the receiver 32 until a threshold torque is applied to the neck 24. The threaded section 136 and the threaded section 138 press against each other to move the neck 24 and the receiver 32 together. As a result of applying this threshold torque, the neck 24 presses against the receiver 32 with enough force to create a seal and prevent leakage of the expellant gas. A seal, shown as gasket 140, may be placed around the neck 24 between a flat surface 142 of the cartridge 20 and a flat surface 144 of the receiver 32. The flat surface 142 and the flat surface 144 are annular and continuous (e.g., the flat surface 142 and the flat surface 144 surround the neck 24). The gasket 140 may be made from a compliant material (e.g., rubber, plastic, etc.). In some embodiments, the gasket 140 is flat and annular (e.g., a washer) in its free or uncompressed state. The gasket 140 is compressed between the flat surface 142 and the flat surface 144 when the threshold torque is applied to the neck 24. The gasket 140 compresses, acting as a seal between the flat surface 142 and the flat surface 144 to prevent leakage of the expellant gas. Additionally, the gasket 140 acts as a spring to bias the threaded section 136 against the threaded section 138 such that friction between the threaded section 136 and the threaded section 138 prevents the connection between the neck 24 and the receiver 32 from loosening unintentionally. The gasket 140 also limits the transfer of vibrations between the neck 24 and the receiver 32.

Referring to FIGS. 3-7, the contact 102 and the contact 104 extend through and are coupled to a body, spacer, or plug, shown as isolator 150. The isolator 150 is made from an electrically insulative material (e.g., plastic, etc.). The isolator 150 separates the contact 102 and the contact 104 from one another, preventing them from contacting one another, which could falsely indicate engagement of the cartridge 20 with the actuator 30. The isolator 150 extends through an aperture defined by the receiver 32 such that the contact 102 and the contact 104 are exposed to the recess 130. As shown, the isolator 150 is coupled to the receiver 32 through a threaded connection. In other embodiments, the isolator 150 is adhered, fastened, or otherwise connected to the receiver 32. In yet other embodiments, the isolator 150 is omitted, and the contact 102 and the contact 104 are directly coupled to the receiver 32, with the receiver 32 made from an insulative material to prevent electrical flow between the contacts. In such embodiments, the receiver 32 may be made from an insulative material to prevent the contact 102 and the contact 104 from electrically coupling to one another without engagement of the cartridge 20.

The threaded section 138 is may also be formed by the contact 102, the contact 104, and/or the isolator 150 (e.g., the contact 102, the contact 104, and the isolator 150 are machined to define threads of the threaded section 138). This facilitates full engagement of the cartridge 20 with the actuator 30 without interference from the contact 102, the contact 104, or the isolator 150. Additionally, this facilitates engagement of the threads of the threaded section 136 with the contact 102 and the contact 104. This ensures a solid electrical connection between the contact 102, the contact 104, and the neck 24.

The placement of the contact 102 and the contact 104 varies between different embodiments. The neck 24 and the receiver 32 both extend along a longitudinal axis 160 when the neck 24 is fully engaged with the receiver 32. In the embodiment shown in FIGS. 3-5, the contact 102 and the contact 104 are arranged substantially perpendicular to the longitudinal axis 106 such that the contact 102 and the contact 104 are arranged in the same longitudinal position. In this configuration, both the contact 102 and the contact 104 engage the same thread or threads of the threaded section 136. Accordingly, both the contact 102 and the contact 104 engage the neck 24 at substantially the same level of engagement of the neck 24 with the receiver 32. The longitudinal position of the contact 102 and the contact 104 may be varied to adjust the point at which the contact 102 and the contact 104 engage the neck 24. By way of example, moving the contact 102 and the contact 104 farther up into the receiver 32 requires a greater level of engagement of the neck 24 with the receiver 32 before the contact 102 and the contact 104 engage the neck 24. As such, the contact 102 and the contact 104 may be positioned such that the circuit 120 is completed only when the neck 24 fully engages the receiver 32.

In an alternative embodiment, shown in FIGS. 6 and 7, the contact 102 and the contact 104 are positioned substantially parallel to the longitudinal axis 160 such that the contact 102 is offset longitudinally from the contact 104. As shown in FIGS. 6 and 7, the contact 104 is positioned longitudinally farther into the receiver 32 than the contact 102. In other embodiments, however, the contact 102 is positioned longitudinally farther into the receiver 32 than the contact 104. In the embodiment shown in FIGS. 6 and 7, the contact 102 engages the neck 24 at a lesser level of engagement of the neck 24 with the receiver 32 than the contact 104. Accordingly, the point at which both the contact 102 and the contact 104 engage the neck 24 is driven by the longitudinal position of the contact 104. The longitudinal position of the contact 104 may be varied to adjust the point at which the contact 102 and the contact 104 engage the neck 24. By way of example, moving the contact 104 farther up into the receiver 32 requires a greater level of engagement of the neck 24 with the receiver 32 before both the contact 102 and the contact 104 engage the neck 24. As such, the contact 104 may be positioned such that the circuit 120 is completed only when the neck 24 fully engages the receiver 32.

Referring to FIGS. 8-11, the threaded section 136 includes external male threads, shown as threads 170, and the threaded section 138 includes corresponding internal female threads, shown as threads 172. The pitch and thread count of the threads 170 and the threads 172 vary between different embodiments. In the embodiments shown in FIGS. 8 and 9, the contact 102 and the contact 104 are arranged longitudinally offset from one another, similar to the embodiment shown in FIGS. 6 and 7. In the embodiment shown in FIG. 8, the contact 102 and the contact 104 each engage approximately a single one of the threads 170. In the embodiment shown in FIG. 9, the contact 102 and the contact 104 each engage multiple of the threads 170. Engaging multiple of the threads 170 with the contact 102 and the contact 104 increases the surface area of neck 24 that is engaged by the contact 102 and the contact 104. This increases the strength of the connections between the contact 102, the contact 104, and the neck 24, making the cartridge monitoring system 100 more resistant to corrosion and to variations in component size due to manufacturing.

Figure 10:
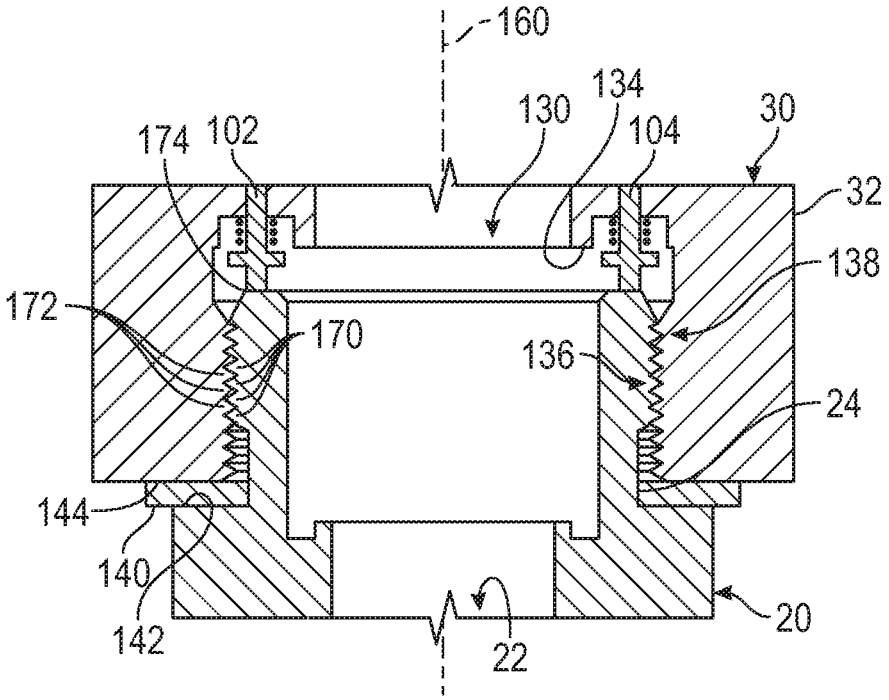
Figure 11:
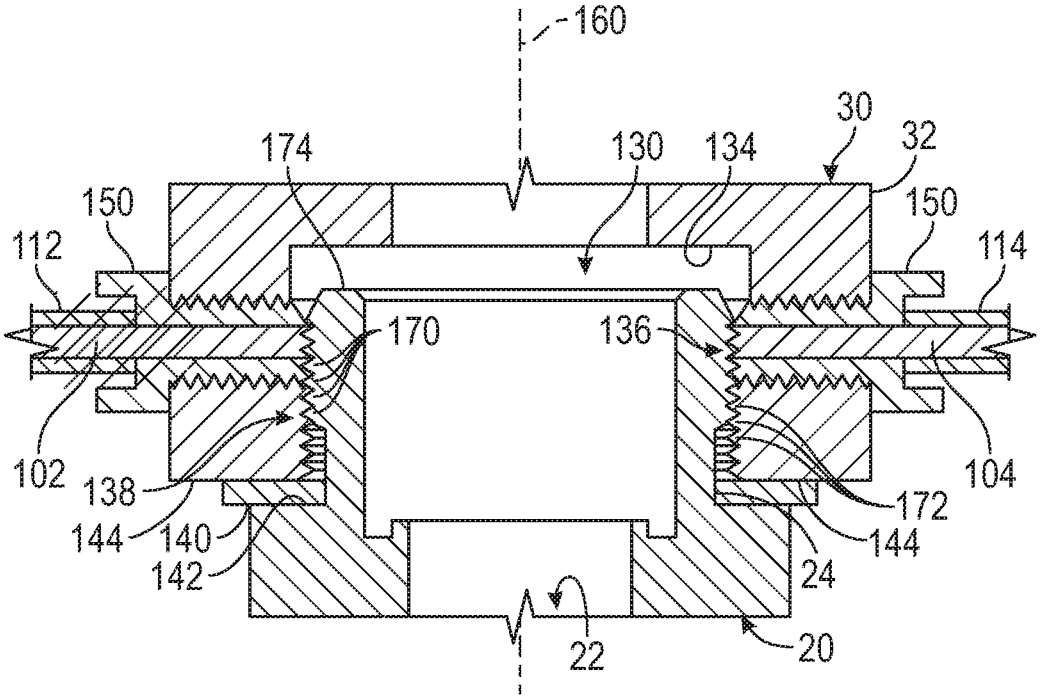

Referring to FIG. 10, the neck 24 defines an annular surface, shown as end surface 174, at the end of the cartridge 20. The end surface 174 is flat and does not include any of the threads 170. The end surface 174 extends substantially perpendicular to the longitudinal axis 160. When the neck 24 is received within the recess 130, the end surface 174 faces the end wall 134 of the receiver 32. In the embodiment shown in FIG. 10, the contact 102 and the contact 104 extend longitudinally through the end wall 134 of the receiver 32 and engage the end surface 174 of the neck 24. The longitudinal positions of the contact 102 and the contact 104 may be adjusted to control when the contact 102 and the contact 104 engage the neck 24. In one embodiment, both the contact 102 and the contact 104 engage the end wall 134 only when the neck 24 is fully engaged with the receiver 32.

In some embodiments, the contact 102 and the contact 104 are biased toward engagement with the neck 24. In the embodiment shown in FIG. 10, a pair of biasing members, shown as compression springs 180, extend between the contact 102 and the receiver 32 and between the contact 104 and the receiver 32. The compression springs 180 apply a biasing force to bias the contact 102 and the contact 104 longitudinally into the recess 130 and accordingly toward the end surface 174. Similarly, biasing members may be used with the embodiment shown in FIG. 8 to bias the contact 102 and the contact 104 radially inward toward engagement with the threads 170. The biasing members force engagement between the contact 102, the contact 104, and the neck 24, increasing the robustness of the connection.

The angular positions of the contact 102 and the contact 104 along the circumference of the recess 130 may be varied. In the embodiment shown in FIGS. 6 and 7, the contact 102 and the contact 104 are located at the same angular position. In the embodiments shown in FIGS. 10 and 11, the contact 102 and the contact 104 are diametrically opposed (i.e., offset 180 degrees from one another). In other embodiments, angular offsets between 0 and 180 degrees are utilized.

In other embodiments, instead of conducting electrical energy through the neck 24, the circuit 120 is completed through an external conductor (e.g., a conductor that is not part of the cartridge 20) when the neck 24 is present in and/or fully engaged with the receiver 32. By way of example, the surfaces of the contacts 104 shown in FIG. 10 that engage the end surface 174 may be non-conductive. Instead, as the neck 24 reaches full engagement with the receiver 32, the end surface 174 pushes the contacts 104 into engagement with an external conductor (e.g., positioned above the contacts 104 as shown in FIG. 10, etc.). Electrical energy would then flow through the external conductor to complete the circuit 120 when the neck 24 is present in and/or fully engaged with the receiver 32.

In some embodiments, multiple cartridges 20 are required for a single installation and may be arranged in relatively close proximity to one another. By way of example, when a large area is to be covered by the fire suppression system 10, multiple assemblies each including a fire suppressant tank 12, a cartridge 20, and an actuator 30 may be utilized to increase the fire suppression capacity of the fire suppression system 10. The actuators 30 may each be separate or may all included in the same housing. In such embodiments, it is desirable to alert an operator if any of the actuators 30 are not fully engaged with a cartridge 20. To accomplish this, multiple circuits 120 may be connected to a single electrical interpreter 110. The electrical interpreter 110 may then be configured to trigger the alarm 118 if less than the threshold current is detected in any of the circuits 120.

Figure 12:
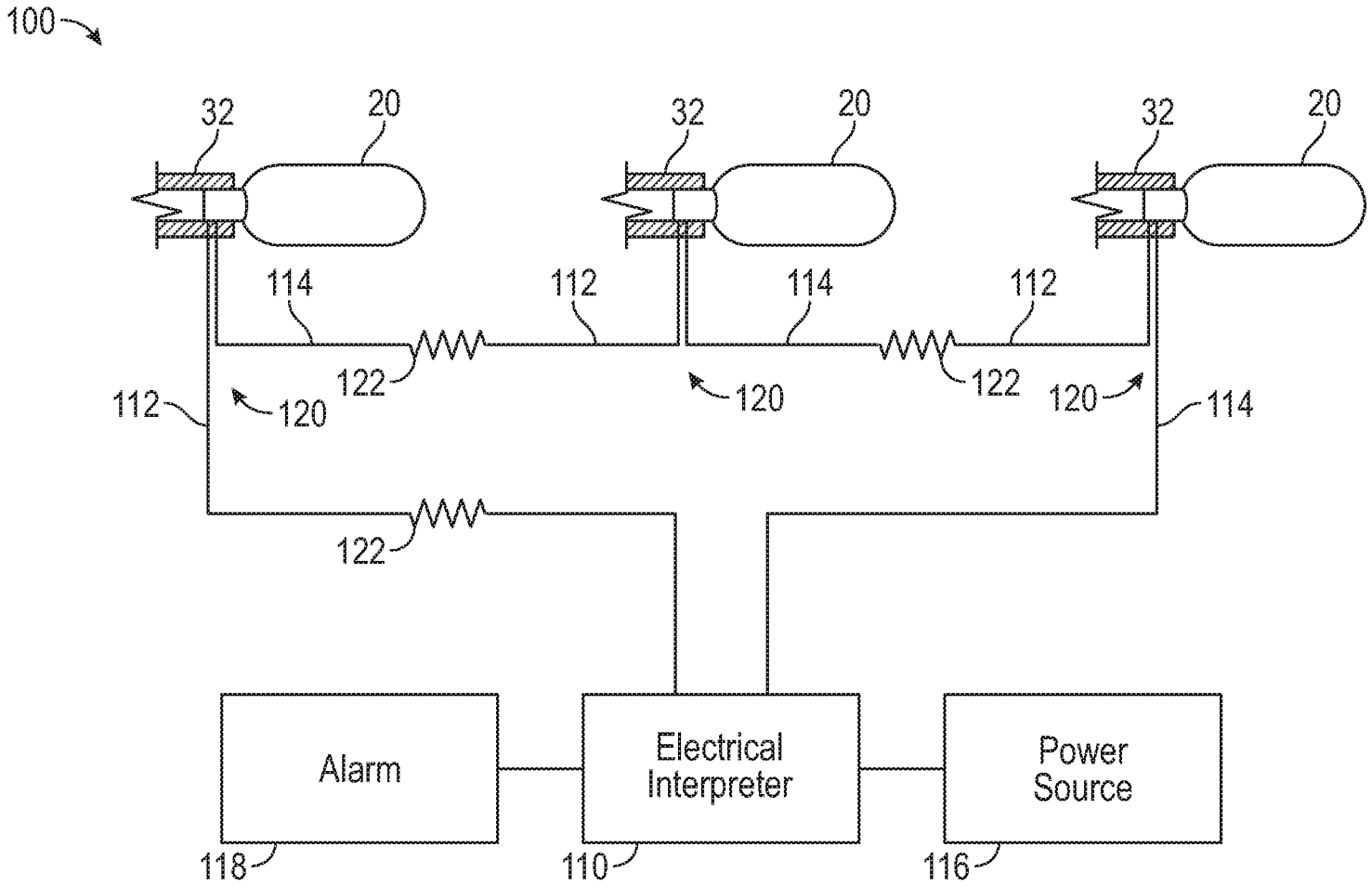
FIG. 12 is a schematic of a cartridge monitoring system of a fire suppression system, according to an exemplary embodiment.
Figure 13:
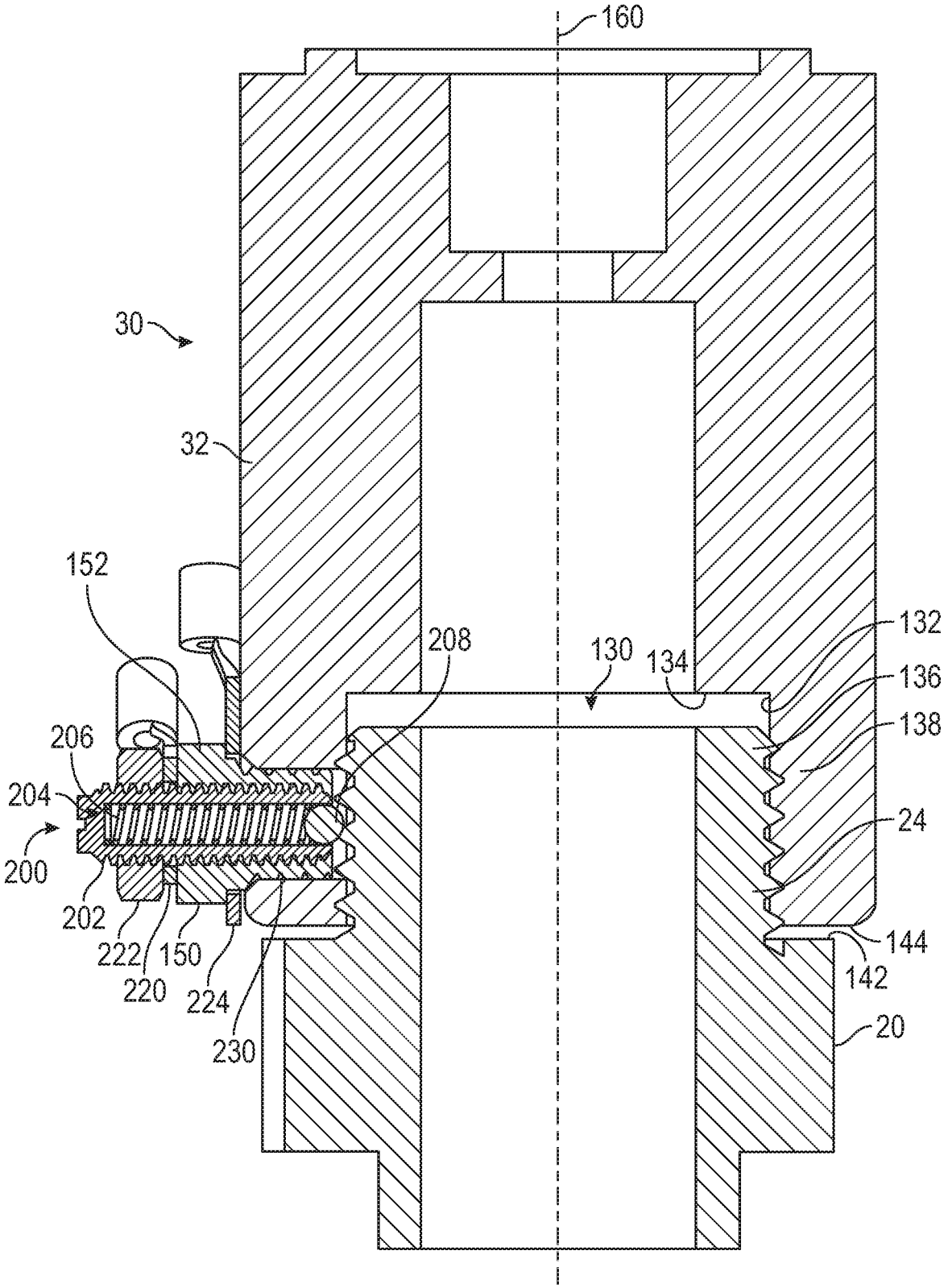
FIG. 13 is a section view of a connection between an actuator and a cartridge, the actuator including a connector assembly, according to an exemplary embodiment.
Figure 15:
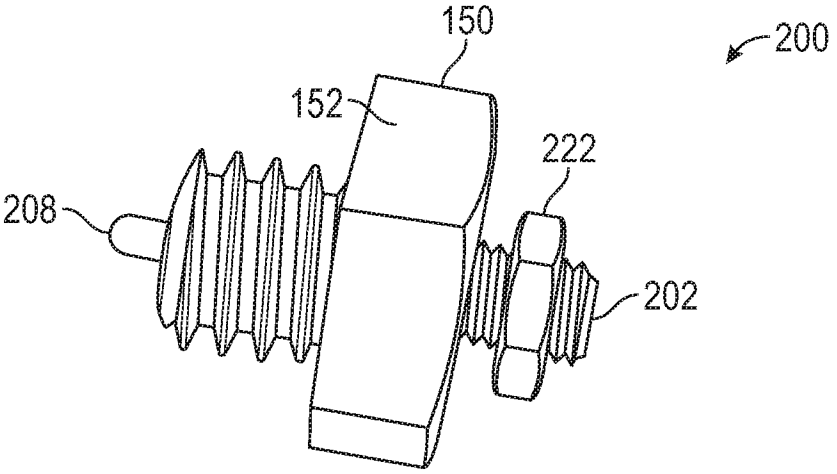
FIG. 15 is a side view of the connector assembly of FIG. 13.
Figure 17:
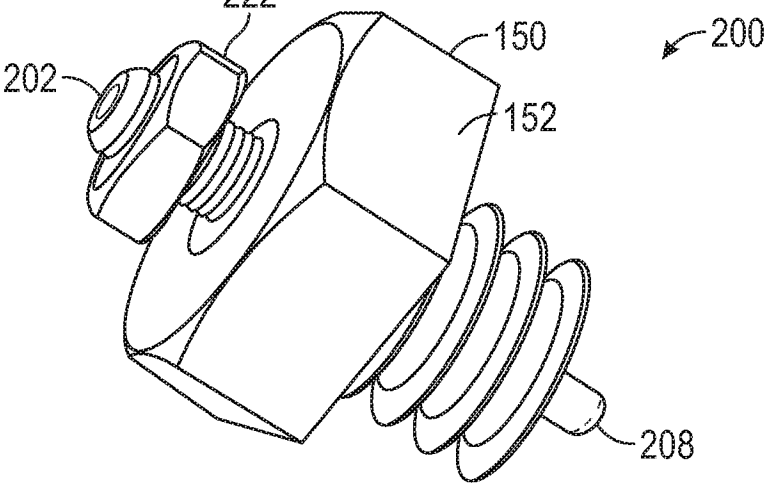
FIG. 17 is another perspective view of the connector assembly of FIG. 13.
Figure 14:
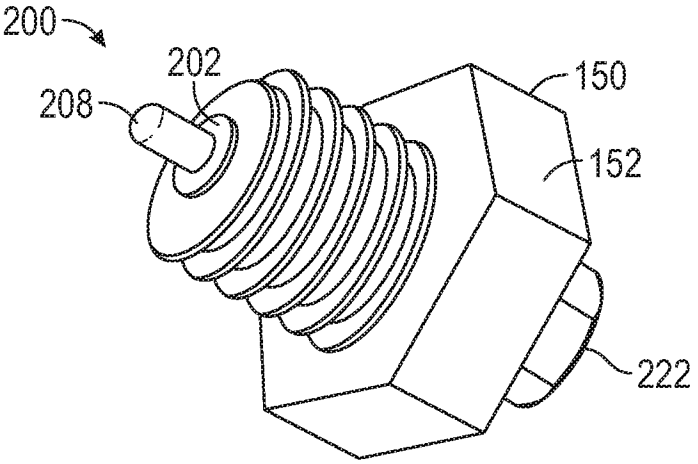
FIG. 14 is a perspective view of the connector assembly of FIG. 13.
Figure 16:
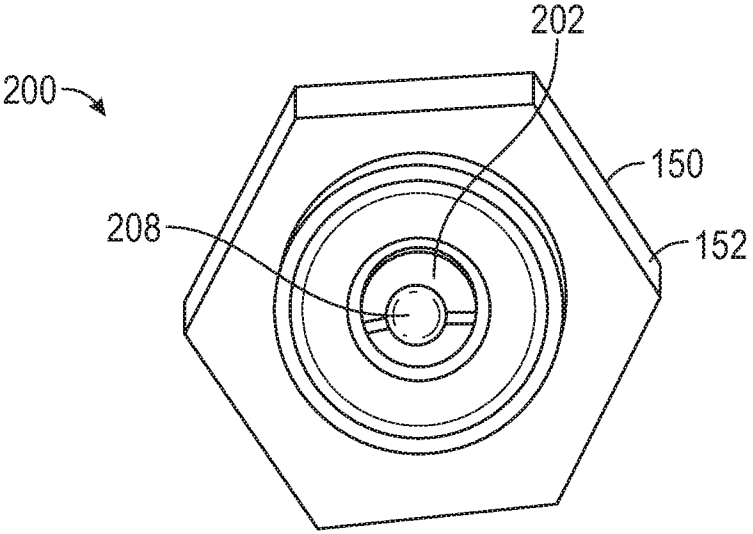
FIG. 16 is a front view of the connector assembly of FIG. 13.

Alternatively, as shown in FIG. 12, the cartridge monitoring system 100 may be simplified by arranging all of the circuits 120 in series. To do this, the wire 112 and the contact 102 of one circuit 120 are coupled to the wire 114 and the contact 104 of an adjacent circuit 120. The wire 112 and the contact 102 of that circuit 120 are coupled to the wire 114 and the contact 104 of another adjacent circuit 120. This pattern continues for all of the remaining circuits 120. The wire 112 and the wire 114 that have not yet been connected to another circuit 120 are connected to the electrical interpreter 110. In this configuration, if any of the actuators 30 are not fully engaged with a cartridge 20, the electrical interpreter 110 will detect an open circuit and activate the alarm 118. One resistive element 122 may be associated with each of the actuators 30. In this case, the resistance of each resistive element 122 may be varied based on events related to the corresponding actuator 30 and cartridge 20 connection. A multiplexer or other sampling circuit may be utilized by the electrical interpreter 110 to sample the voltage across each resistive element 122 using the same analog/digital interface.

In alternative embodiments, the cartridge monitoring system 100 is usable with other types of connectors. By way of example, the cartridge monitoring system 100 may be used to determine if a quick disconnect connector is fully engaged. Quick disconnect connectors typically include a male fitting defining an annular groove and a female fitting configured to receive the male fitting. The female fitting includes a series of ball bearings that may be selectively inserted into the annular groove of the male fitting to couple the male fitting and the female fitting. In such an embodiment, the contact 102 and the contact 104 may be coupled to the female fitting and arranged such that contact 102 and the contact 104 engage the male fitting when the quick disconnect connector is fully engaged.

Referring to FIGS. 13-17, the actuator 30 includes a switch, shown as contact assembly 200, according to an exemplary embodiment. The contact assembly 200 includes a body or housing (e.g., a contact housing, a contact body, etc.), shown as detent housing 202. The detent housing 202 is substantially cylindrical and has an exterior threaded surface extending along its length. The detent housing 202 extends through an aperture defined by the isolator 150. Specifically, the exterior threaded surface is configured to threadedly engage an interior threaded surface of the isolator 150 to couple the detent housing 202 to the isolator 150. The detent housing 202 may define an interface (e.g., a slot, a cross-shaped recess, a Torx recess, a series of exterior flats, etc.) to facilitate torque transfer to the detent housing 202 from a tool (e.g., a wrench, a screwdriver, etc.) during installation of the detent housing 202 with the isolator 150.

The detent housing 202 defines a recess (e.g., a contact recess, a ball detent recess, a detent recess, etc.), shown as ball recess 204, that extends along a length of the detent housing 202, with the end of the detent housing 202 positioned opposite the cartridge 20 being closed. The detent housing 202 is positioned such that the ball recess 204 extends radially relative to the longitudinal axis 160 (e.g., substantially perpendicular to the longitudinal axis 160). The ball recess 202 receives a biasing element, shown as spring 206, and a detent (e.g., a ball detent, a frustoconical conical detent, etc.), shown as contact 208. The spring 206 is positioned between the closed end of the detent housing 202 and the contact 208 such that the spring 206 biases the contact 208 radially inward toward the longitudinal axis 160 and the cartridge 20.

A first electrical conductor, shown as terminal 220, is configured to be coupled to the electrical interpreter 110 (e.g., by the wire 112). A fastener, shown as nut 222, is threaded onto the detent housing 202. In other embodiments, the nut 222 is fixedly coupled to the detent housing 202. The terminal 220 extends around the detent housing 202 between the nut 222 and the isolator 202. The terminal 220 may be spade, hook, ring, or otherwise shaped to facilitate this placement of the terminal 220. The nut 222 is tightened, securing the terminal 220 against the nut 222 and a shoulder 152 of the isolator 150, holding the terminal 220 in place.

The contact 208 acts as the contact 102 described elsewhere herein. The contact 208 is electrically coupled to the electrical interpreter 110. Specifically, the terminal 220 is electrically coupled to the contact 208 through: engagement of the terminal 220 with the nut 222 and/or the detent body 202; engagement of the nut 222 with the detent body 202; engagement of the detent body 202 with the spring 206; and engagement of the contact 208 with the detent body 202 and/or the spring 206. Accordingly, the terminal 220, the detent body 202, the nut 222, the spring 206, and/or the contact 208 may include an electrically-conductive material (e.g., a metal such as steel or copper) to facilitate this electrical coupling.

A second electrical conductor, shown as terminal 224, is configured to be coupled to the electrical interpreter 110 (e.g., by the wire 114). The terminal 224 extends around the isolator 150 between the shoulder 152 and the receiver 32. The terminal 224 may be spade, hook, ring, or otherwise shaped to facilitate this placement of the terminal 224. The isolator 150 is tightened, compressing the terminal 224 against the shoulder 152 and the receiver 32, holding the terminal 224 in place.

The receiver 32 acts as the contact 104 described elsewhere herein. The receiver 32 is electrically coupled to the electrical interpreter 110 through engagement of the terminal 224 with the receiver 32. The terminal 224 and at least a portion or section of the receiver 32 may include an electrically-conductive material to facilitate this electrical coupling. The isolator 150 surrounds the detent body 202, extending between the receiver 32 and the detent body 202. The isolator 150 insulates the detent body 202, electrically decoupling the detent body 202 from the receiver 32.

To assemble the contact assembly 200 with the receiver 32, the terminal 224 is placed between the isolator 150 and the receiver 32. The isolator 150 and the detent body 202 are inserted through an aperture 230 defined by the receiver 32, and the isolator 150 is tightened until the shoulder 152 engages the terminal 224 and the terminal 224 engages the receiver 32. The terminal 220 is placed such that the terminal 220 receives the detent body 202. The nut 222 is placed onto the detent body 202 and tightened until the nut 222 contacts the terminal 220 and the terminal 220 contacts the shoulder 150.

Before the neck 24 of the cartridge 20 is fully inserted into the recess 130 of the receiver 32, the contact 208 extends into the recess 130. When the neck 24 is first inserted, the neck 24 engages the receiver 32, electrically coupling the neck 24 to the terminal 224 through the receiver 32. When the end of the neck 24 reaches the longitudinal position of the contact 208, the neck 24 engages the contact 208, electrically coupling the neck 24 to the terminal 220 through the contact 208. Accordingly, at this point, the neck 24 completes the circuit 120. As the neck 24 is further inserted, a curved surface of the contact 208 presses against the neck 24, forcing the contact 208 to retract into the ball recess 204. The spring 206 maintains a biasing force to hold the contact 208 against the neck 24. The biasing force of the spring 206 may improve the strength and durability of the connection between the contact 208 and the neck 24 relative to a contact that is fixed in place and not biased against the neck 24.

In other embodiments, the cartridge monitoring system 100 is usable to monitor the connections between other types of components. Generally, the cartridge monitoring system 100 may be configured to determine if a first component (e.g., a container, an adapter, a conduit, a pump, an actuator, etc.) is coupled to a second component (e.g., a container, an adapter, a conduit, a pump, an actuator, etc.) where the first component includes a receiver defining a recess that receives a protrusion (e.g., a neck, a boss, etc.) of the second component. In such an arrangement, the cartridge monitoring system 100 includes at least one contact that extends into the recess to engage an electrically-conductive portion of the protrusion of the second component. In some embodiments, a fluid (e.g., liquid, gas, etc.) flows through the receiver and the protrusion. By way of example, in some fire suppression systems, the cartridge 20 is omitted, and the fire suppressant tank 12 is filled with pressurized expellant gas. In such an embodiment, the cartridge monitoring system 100 may be used to monitor the connection between the fire suppressant tank 12 and an actuator that controls the flow of fire suppressant agent out of the fire suppressant tank 12. In other embodiments, the cartridge monitoring system 100 is configured for use in other industries (e.g., to determine when two hoses are connected, to determine when a tank of breathable air is coupled to a manifold in a medical or diving application, to determine when an air tank is coupled to a paintball marker, etc.).

Configuration of Exemplary Embodiments

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the fire suppression system as shown in the various exemplary embodiments is illustrative only. Additionally, any element disclosed in one embodiment may be incorporated or utilized with any other embodiment disclosed herein. For example, the contact assembly 200 of the exemplary embodiment shown in at least FIG. 13 may be incorporated into the actuator 30 of the exemplary embodiment shown in at least FIG. 5. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A fire suppression system, comprising:

a tank configured to contain fire suppressant agent;

a cartridge configured to contain pressurized expellant gas, the cartridge including a neck that defines an electrically-conductive section and a first threaded section that defines a plurality of threads;

an actuator coupled to the tank and selectively coupled to the cartridge, wherein the actuator receives the neck when the cartridge is coupled to the actuator, and wherein the actuator is configured to selectively supply the pressurized expellant gas from the cartridge to the tank such that the fire suppressant agent is dispensed from the tank; and a cartridge monitoring system coupled to the actuator, the cartridge monitoring system comprising:

a first contact and a second contact configured to engage the electrically-conductive section of the cartridge when the cartridge is coupled to the actuator; and an electrical interpreter coupled to the first contact and the second contact and configured to determine if the electrically-conductive section of the cartridge is engaging the first contact and the second contact to form a closed electrical circuit through the first contact, the electrically-conductive section of the cartridge, and the second contact, wherein the first threaded section engages a corresponding second threaded section of the actuator to couple the cartridge to the actuator, and wherein at least one of the first contact and the second contact engage at least one of the plurality of threads.

2. The fire suppression system of claim 1, wherein the cartridge monitoring system further comprises a notifier coupled to the electrical interpreter and configured to provide a notification to an operator in response to a determination that an open circuit has been formed between the first contact and the second contact.

3. The fire suppression system of claim 1, wherein the actuator includes a receiver that is configured to receive the electrically-conductive section of the cartridge to couple the cartridge to the actuator, wherein the receiver is electrically-conductive, and wherein the receiver is the second contact.

4. The fire suppression system of claim 3, wherein the actuator further includes an isolator coupled to the receiver and the first contact, and wherein the isolator is configured to electrically decouple the first contact from the receiver.

5. The fire suppression system of claim 4, further comprising a spring coupled to the isolator, wherein the first contact is translatably coupled to the isolator, and wherein the spring is configured to bias the first contact into engagement with the cartridge.

6. The fire suppression system of claim 1, further comprising a spring configured to bias at least one of the first contact and the second contact into engagement with the cartridge.

7. The fire suppression system of claim 1, wherein the cartridge monitoring system further comprises a resistor coupled to one of the first contact and the second contact such that the closed electrical circuit is formed through the electrical interpreter, the first contact, the electrically-conductive section, the second contact, and the resistor when the cartridge is coupled to the actuator.

8. The fire suppression system of claim 1, wherein the cartridge is a first cartridge, the electrically-conductive section is a first electrically-conductive section, and the actuator is a first actuator, further comprising:

a second cartridge configured to contain pressurized expellant gas, the second cartridge including a second electrically-conductive section; and a second actuator selectively coupled to the second cartridge;

wherein the cartridge monitoring system further comprises a third contact and a fourth contact configured to engage the second electrically-conductive section of the second cartridge when the second cartridge is coupled to the second actuator; and wherein the second contact is coupled to the third contact such that the closed electrical circuit is formed through the first contact, the first electrically-conductive section, the second contact, the third contact, the second electrically-conductive section, and the fourth contact when the first cartridge is coupled to the first actuator and the second cartridge is coupled to the second actuator.

9. The fire suppression system of claim 1, wherein determining if the electrically-conductive section of the cartridge is engaging the first contact and the second contact to form the closed electrical circuit includes:

supplying a voltage across the first contact and the second contact such that a current flows through the first contact, the electrically-conductive section, and the second contact when the closed electrical circuit is formed; and monitoring the current to determine if the cartridge is engaging the first contact and the second contact.

10. The fire suppression system of claim 9, further comprising a resistor having a variable resistance electrically coupled between the electrical interpreter and the first contact, wherein the electrical interpreter is configured to perform an action in response to the resistance of the resistor falling within a predetermined range.

11. A fire suppression system, comprising:

a tank configured to contain fire suppressant agent;

a cartridge configured to contain pressurized expellant gas, the cartridge including an electrically-conductive section;

an actuator coupled to the tank and selectively coupled to the cartridge, wherein the actuator is configured to selectively supply the pressurized expellant gas from the cartridge to the tank such that the fire suppressant agent is dispensed from the tank, wherein the actuator includes:

a receiver configured to receive the electrically-conductive section of the cartridge to couple the cartridge to the actuator, wherein the receiver is electrically-conductive;

an isolator coupled to the receiver and a contact, wherein the isolator is configured to electrically decouple the contact from the receiver;

a contact body coupled to the isolator, the contact body defining a contact recess that receives the contact, wherein the contact is translatable along a length of the contact recess; and a spring positioned within the contact recess and configured to bias the contact toward the electrically-conductive section of the cartridge; and a cartridge monitoring system coupled to the actuator, the cartridge monitoring system including an electrical interpreter coupled to the contact and the receiver and configured to determine if the electrically-conductive section of the cartridge is engaging the contact and the receiver to form a closed electrical circuit through the contact, the electrically-conductive section of the cartridge, and the receiver, wherein the contact and the receiver are configured to engage the electrically-conductive section of the cartridge when the cartridge is coupled to the actuator.

12. The fire suppression system of claim 11, wherein the cartridge includes a neck that is received by the receiver when the cartridge is coupled to the actuator, and wherein the neck defines the electrically-conductive section.

13. The fire suppression system of claim 12, wherein the neck extends along a longitudinal axis when the cartridge is coupled to the actuator, and wherein the spring is configured to apply a biasing force on the contact approximately perpendicular to the longitudinal axis.

14. The fire suppression system of claim 13, further comprising:

a first terminal electrically coupled to the electrical interpreter, the first terminal being electrically coupled to the contact through the contact body; and a second terminal electrically coupled to the electrical interpreter, the second terminal being electrically coupled to the receiver, wherein the isolator extends between the first terminal and the second terminal.

15. The fire suppression system of claim 14, further comprising a fastener in threaded engagement with the contact body, wherein the first terminal extends between the fastener and the isolator; and wherein the isolator defines a shoulder, and wherein the second terminal extends between the shoulder and the receiver.

16. A fire suppression system, comprising:

a tank configured to contain fire suppressant agent;

a cartridge configured to contain pressurized expellant gas, the cartridge including an electrically-conductive section;

an actuator coupled to the tank, selectively coupled to the cartridge, and configured to selectively supply the pressurized expellant gas from the cartridge to the tank such that the fire suppressant agent is dispensed from the tank, wherein the actuator includes:

an electrically-conductive receiver that is configured to receive the electrically-conductive section of the cartridge to couple the cartridge to the actuator;

an isolator coupled to the receiver and to a contact, wherein the isolator is configured to electrically decouple the contact from the receiver;

a contact body coupled to the isolator, the contact body defining a contact recess that receives the contact, wherein the contact is translatable along a length of the contact recess; and a spring positioned within the contact recess and configured to bias the contact toward the electrically-conductive section of the cartridge; and a cartridge monitoring system coupled to the actuator, the cartridge monitoring system comprising:

the contact and the receiver, wherein the contact and the receiver are configured to engage the electrically-conductive section of the cartridge when the cartridge is coupled to the actuator; and an electrical interpreter coupled to the contact and the receiver and configured to determine if the electrically-conductive section of the cartridge is engaging the contact and the receiver to form a closed circuit.

* * * * *